US009251735B2

(12) United States Patent
Mun

(10) Patent No.: US 9,251,735 B2
(45) Date of Patent: Feb. 2, 2016

(54) DISPLAY DEVICE AND METHOD OF CONTROLLING A GATE DRIVING CIRCUIT HAVING TWO SHIFT MODES

(71) Applicant: LG DISPLAY CO., LTD., Seoul (KR)

(72) Inventor: Kyeongsu Mun, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 131 days.

(21) Appl. No.: 14/073,703

(22) Filed: Nov. 6, 2013

(65) Prior Publication Data

US 2014/0168282 A1 Jun. 19, 2014

(30) Foreign Application Priority Data

Dec. 14, 2012 (KR) ..... 10-2012-0146064

(51) Int. Cl.
*G09G 3/36* (2006.01)
*G09G 3/32* (2006.01)

(52) U.S. Cl.
CPC ..... *G09G 3/3266* (2013.01); *G09G 3/3677* (2013.01); *G09G 2310/0267* (2013.01); *G09G 2310/0281* (2013.01); *G09G 2310/0283* (2013.01); *G09G 2310/08* (2013.01); *G09G 2330/08* (2013.01)

(58) Field of Classification Search
CPC ..... G11C 19/28; G11C 19/00; G11C 19/184; G11C 19/202
USPC ..... 345/98–100
See application file for complete search history.

(56) References Cited

U.S. PATENT DOCUMENTS

| | | | | |
|---|---|---|---|---|
| 8,477,094 | B2 | 7/2013 | Jung et al. | |
| 2005/0156865 | A1* | 7/2005 | Suh | 345/100 |
| 2011/0025590 | A1* | 2/2011 | Lin et al. | 345/100 |
| 2011/0069044 | A1* | 3/2011 | Lee et al. | 345/204 |
| 2012/0306844 | A1* | 12/2012 | Abe et al. | 345/212 |

FOREIGN PATENT DOCUMENTS

KR 10-2011-0077109 A 7/2011

* cited by examiner

*Primary Examiner* — Long D Pham
(74) *Attorney, Agent, or Firm* — Birch, Stewart, Kolasch & Birch, LLP

(57) ABSTRACT

A display device and a method of controlling a gate driving circuit thereof are discussed. The display device includes a display panel, first and second gate driving circuits which are respectively disposed on both sides of the display panel, and a timing controller. The timing controller controls the first and second gate driving circuits in conformity with a first shift mode, compares carry signals received from the first and second gate driving circuits, and controls the first and second gate driving circuits in conformity with a second shift mode when a time interval between the carry signals is greater than a previously determined reference value.

6 Claims, 12 Drawing Sheets

DISPLAY DEVICE AND METHOD OF CONTROLLING A GATE DRIVING CIRCUIT HAVING TWO SHIFT MODES

This application claims the benefit of Korean Patent Application No. 10-2012-0146064 filed on Dec. 14, 2012, the entire contents of which is incorporated herein by reference for all purposes as if fully set forth herein.

BACKGROUND OF THE INVENTION

1. Field of the Invention

Embodiments of the invention relate to a display device having a bidirectional shift function and a method of controlling a gate driving circuit thereof.

2. Discussion of the Related Art

Various flat panel displays (FPDs), which may replace cathode ray tubes (CRTs) disadvantageous to the weight and the volume, have been developed and have been put on the market. In general, a gate driving circuit of the flat panel display sequentially supplies a gate pulse (or scan pulse) to gate lines using a shift register. Pixels, to which data is written by the gate pulse, are selected on a per line basis of a display panel. The gate driving circuit has a bidirectional shift function capable of changing a shift direction of the gate pulse, so as to support various driving methods.

Control signals and power voltages required to operate the gate driving circuit are supplied to the gate driving circuit through lines. If the lines are short-circuited or opened, an incorrect operation of the gate driving circuit may be generated or an output of the gate driving circuit may not be generated. Further, a polarizing film attached to the display panel is excited by the heat generation of the gate driving circuit. When static electricity is applied to the gate driving circuit, an abnormal operation of the gate driving circuit may be generated.

The gate driving circuits may be disposed on both sides of the display panel. In this instance, when any output is not generated in the gate driving circuit disposed on one side of the display panel, an image is displayed only on a portion of a screen of the display panel.

SUMMARY OF THE INVENTION

Embodiments of the invention provide a display device and a method of controlling gate driving circuits thereof capable of preventing only a portion of a screen of a display panel from being driven by an abnormal operation of the gate driving circuits when the gate driving circuits are disposed on both sides of the display panel.

In one aspect, there is a display device comprising a display panel including data lines, gate lines crossing the data lines, and a pixel array, first and second gate driving circuits which are respectively disposed on both sides of the display panel with the pixel array interposed between them, and a timing controller configured to control a shift direction of the first and second gate driving circuits using a gate timing control signal.

The first and second gate driving circuits shift a gate pulse supplied to the gate lines along a first scan direction in a first shift mode and shift the gate pulse along a second scan direction opposite to the first scan direction in a second shift mode.

The timing controller controls the first and second gate driving circuits in conformity with the first shift mode, compares carry signals received from the first and second gate driving circuits, and controls the first and second gate driving circuits in conformity with the second shift mode when a time interval between the carry signals is greater than a previously determined reference value.

In another aspect, there is a method of controlling a gate driving circuit of a display device including a display panel including data lines, gate lines crossing the data lines, and a pixel array, first and second gate driving circuits which are respectively disposed on both sides of the display panel with the pixel array interposed between them, and a timing controller controlling a shift direction of the first and second gate driving circuits using a gate timing control signal, the method comprising controlling the first and second gate driving circuits in conformity with a first shift mode, comparing carry signals received from the first and second gate driving circuits, and when a time interval between the carry signals is greater than a previously determined reference value, controlling the first and second gate driving circuits in conformity with a second shift mode.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

A display device according to an exemplary embodiment of the invention may be implemented as a flat panel display, such as a liquid crystal display (LCD), a field emission display (FED), a plasma display panel (PDP), an organic light emitting display, and an electrophoresis display (EPD). In the following description, the embodiment of the invention will be described using the organic light emitting display as an example of the flat panel display. Other types of flat panel displays may be used.

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

Figure 1:
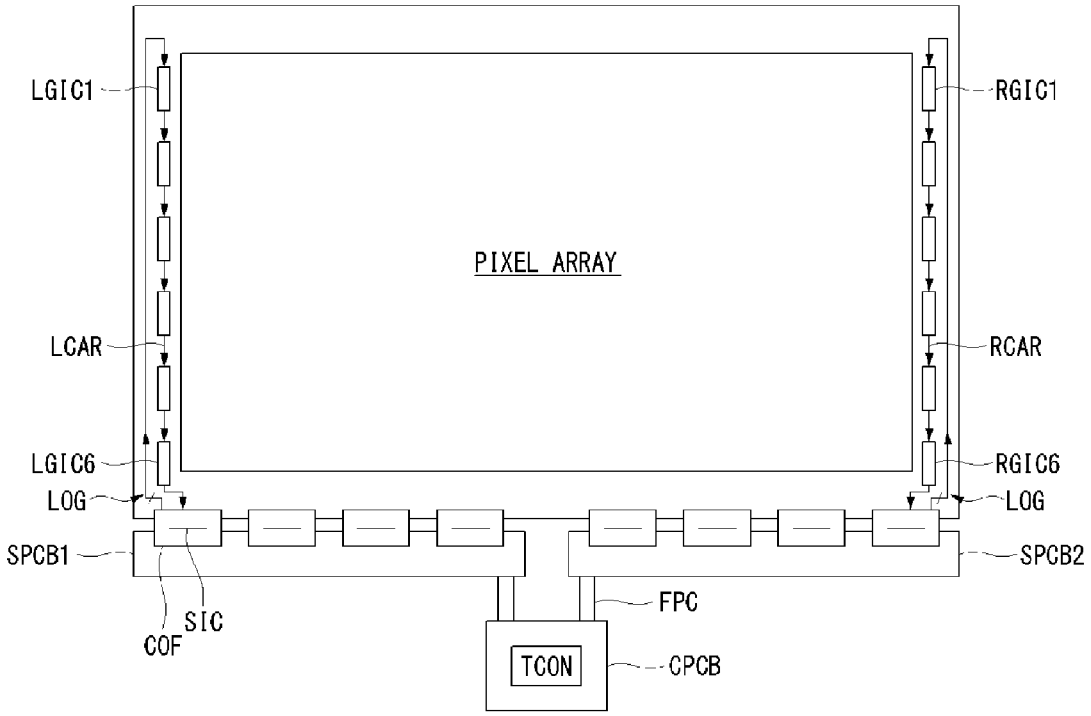
FIG. 1 is a block diagram illustrating an example of a first shift mode operation of gate driver integrated circuits (ICs) in a display device according to an exemplary embodiment of the invention.
Figure 2:
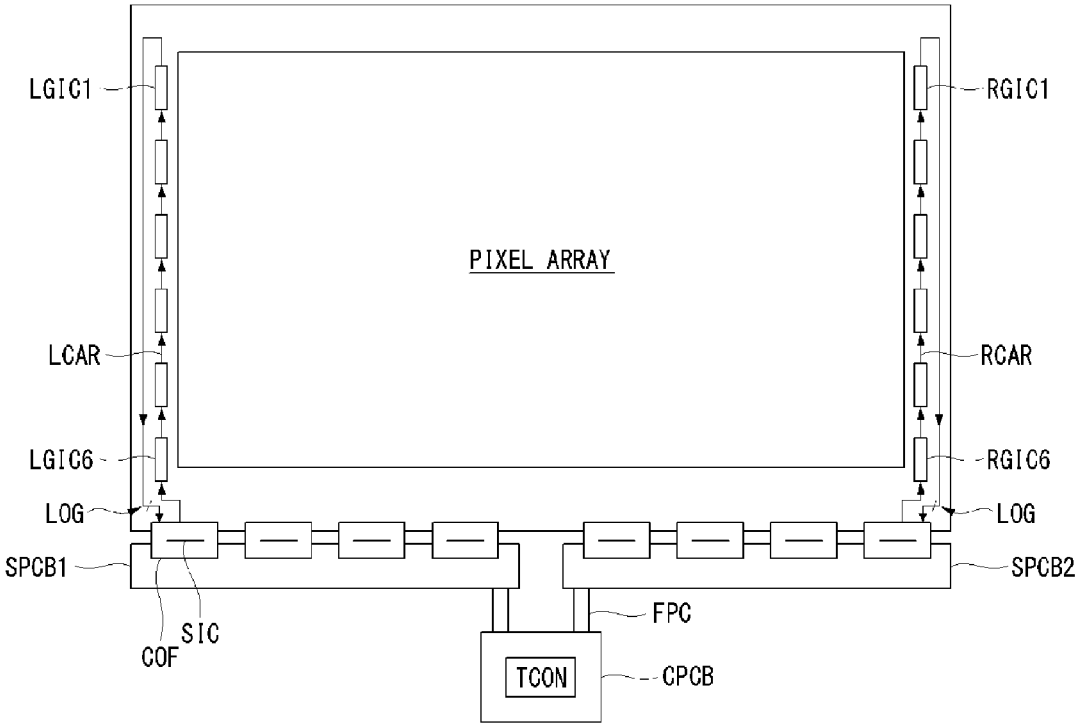
FIG. 2 is a block diagram illustrating an example of a second shift mode operation of gate driver ICs shown in FIG. 1.
Figure 3:
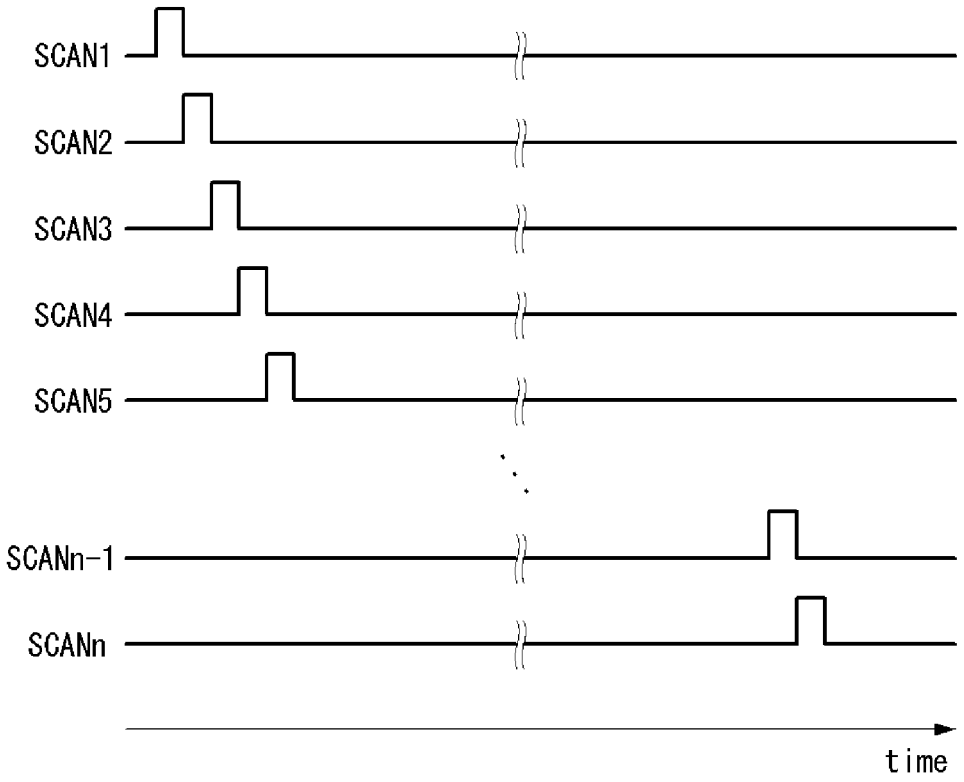
FIG. 3 is a waveform diagram showing an output of gate driver ICs in a first shift mode.
Figure 4:
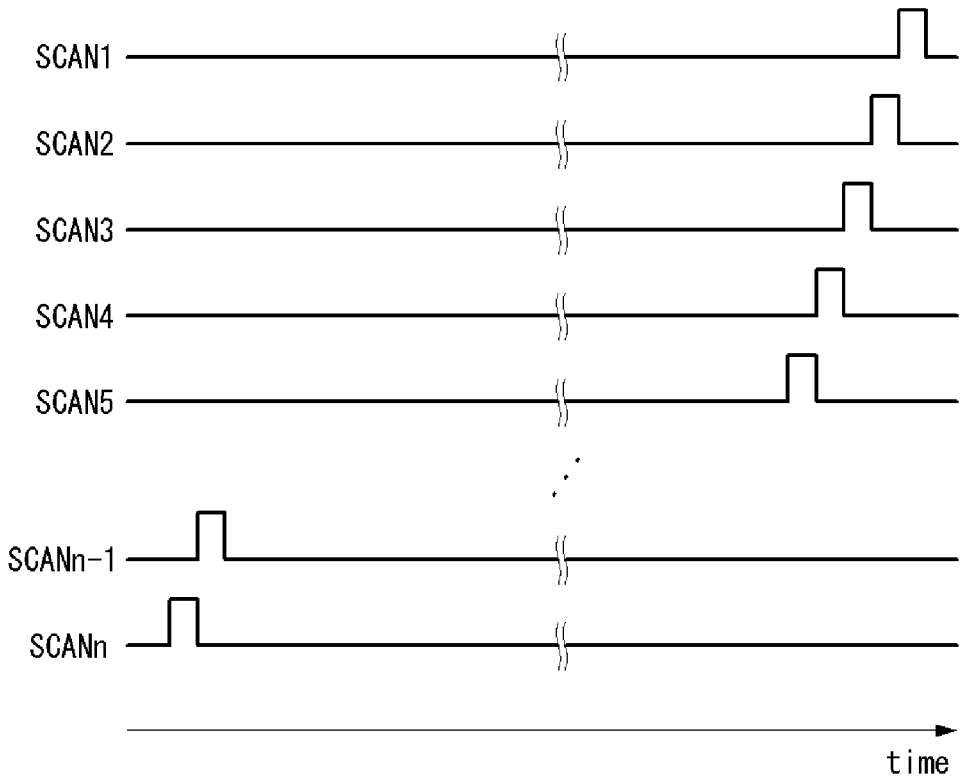
FIG. 4 is a waveform diagram showing an output of gate driver ICs in a second shift mode.

FIG. 1 is a block diagram illustrating an example of a first shift mode operation of gate driver integrated circuits (ICs) in a display device according to an exemplary embodiment of the invention. FIG. 2 is a block diagram illustrating an example of a second shift mode operation of the gate driver ICs shown in FIG. 1. FIG. 3 is a waveform diagram showing an output of the gate driver ICs in a first shift mode. FIG. 4 is a waveform diagram showing an output of the gate driver ICs in a second shift mode.

As shown in FIGS. 1 to 4, the display device according to the embodiment of the invention includes a display panel including a pixel array.

The pixel array of the display panel includes data lines, gate lines crossing the data lines, and pixels arranged in a matrix form defined by the data lines and the gate lines. A polarizing film may be attached to the display panel.

First and second gate driving circuits are disposed on the display panel with the pixel array interposed between them. Namely, the first and second gate driving circuits are dividedly disposed on both sides of the display panel. The first gate driving circuit includes gate driver ICs LGIC1 to LGIC6 of a first group, and the second gate driving circuit includes gate driver ICs RGIC1 to RGIC6 of a second group. The gate driver ICs LGIC1 to LGIC6 of the first group and the gate driver ICs RGIC1 to RGIC6 of the second group each output a scan pulse under the control of a timing controller TCON and each include a shift register for shifting the scan pulse. The gate driver ICs LGIC1 to LGIC6 of the first group are disposed outside the left side of the pixel array and are cascade-connected to one another. The gate driver ICs LGIC1 to LGIC6 of the first group sequentially supply a gate pulse to the gate lines of the display panel. The gate driver ICs RGIC1 to RGIC6 of the second group are disposed outside the right side of the pixel array and are cascade-connected to one another. The gate driver ICs RGIC1 to RGIC6 of the second group sequentially supply the gate pulse to the gate lines of the pixel array. The gate driver ICs LGIC1 to LGIC6 and RGIC1 to RGIC6 may be bonded to a substrate of the display panel through a chip-on-glass (COG) process. Line-on-glass (LOG) lines supplying a gate timing control signal and power voltage to the gate driver ICs LGIC1 to LGIC6 and RGIC1 to RGIC6 are formed on the substrate of the display panel. The gate driver ICs LGIC1 to LGIC6 and RGIC1 to RGIC6 may be implemented as a known gate driver IC having a bidirectional shift function. For example, the gate driver ICs LGIC1 to LGIC6 and RGIC1 to RGIC6 may be implemented as a shift register disclosed in detail in Korean Patent Application No. 10-2009-0133572 (Dec. 30, 2009) and U.S. patent application Ser. No. 12/845,332 (Jul. 28, 2010) corresponding to the present applicant, and which are hereby incorporated by reference in their entirety.

Source driver ICs SIC are disposed on the upper side or the lower side of the display panel. A chip-on-film (COF), on which the source driver ICs SIC are mounted, is bonded to the substrate of the display panel and printed circuit boards (PCBs) SPCB1 and SPCB2. If the display panel is a large-screen display panel, a source PCB may be divided into the two source PCBs SPCB1 and SPCB2 as shown in FIG. 1. The source driver ICs SIC convert digital video data received from the timing controller TCON into a data voltage and supply the data voltage to the data lines of the pixel array.

Figure 8:
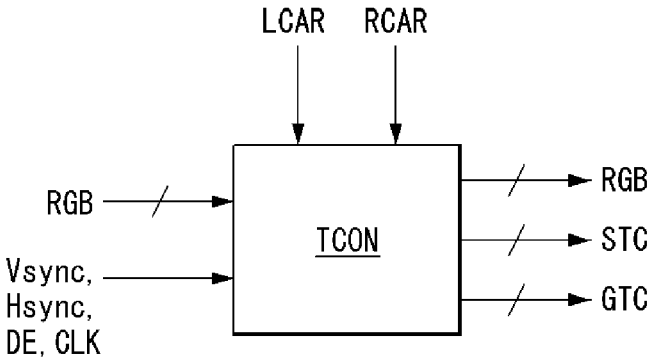
FIG. 8 illustrates input and output signals of a timing controller.

The timing controller TCON may be mounted on a control PCB CPCB. The control PCB CPCB is connected to the source PCBs SPCB1 and SPCB2 through a flexible circuit, such as a flexible printed circuit (FPC), and a cable. The timing controller TCON rearranges digital video data RGB (refer to FIG. 8) received from an external host system based on the arrangement of the pixels on the display panel and transmits the rearranged digital video data RGB to the source driver ICs SIC. As shown in FIG. 8, the timing controller TCON generate a source timing control signal STC for controlling operation timing of the source driver ICs SIC and a gate timing control signal GTC for controlling operation timing of the gate driver ICs LGIC1 to LGIC6 and RGIC1 to RGIC6 using timing signals, such as a vertical sync signal Vsync, a horizontal sync signal Hsync, a data enable signal DE, and a main clock CLK. The source timing control signal STC includes a source start pulse SSP, a source sampling clock SSC, a source output enable signal SOE, and the like. The gate timing control signal GTC includes gate start pulses GSPF and GSPR for controlling start timing of the gate pulse, a gate shift clock GSC for controlling shift timing of the gate pulse, a gate output enable signal GOE for controlling output timing of the gate pulse, a shift direction control signal DIR, and the like.

The host system may be implemented as one of a television system, a set-top box, a navigation system, a DVD player, a Blu-ray player, a personal computer (PC), a home theater system, and a phone system. The host system transmits digital video data of an input image and the timing signals Vsync, Hsync, DE, and CLK synchronized with the digital video data to the timing controller TCON.

The timing controller TCON may control a shift direction of the gate driver ICs LGIC1 to LGIC6 and RGIC1 to RGIC6 using the gate timing control signal GTC. When the gate driver ICs LGIC1 to LGIC6 and RGIC1 to RGIC6 operate in a first shift mode, they shift the gate pulse along a first scan direction travelling from the top to the bottom of the display panel. When the gate driver ICs LGIC1 to LGIC6 and RGIC1 to RGIC6 operate in a second shift mode, they shift the gate pulse along a second scan direction travelling from the bottom to the top of the display panel. The second scan direction is opposite to the first scan direction.

Figure 5A:
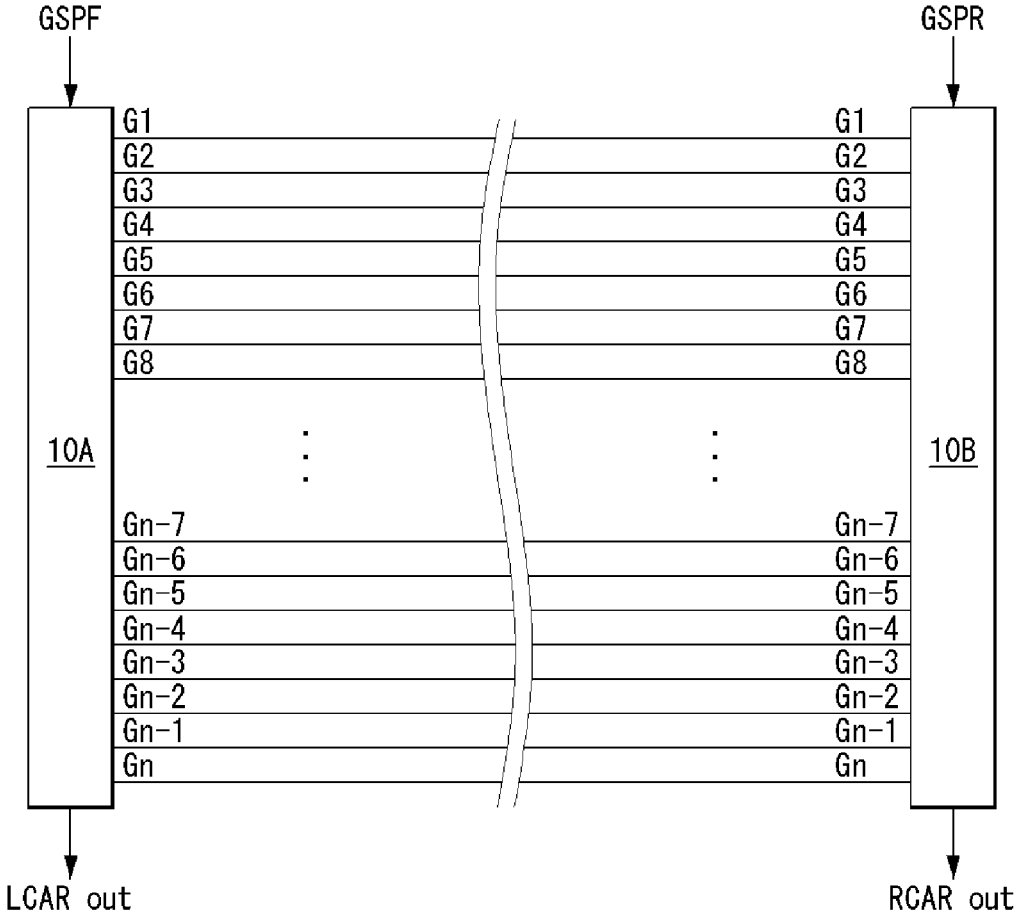
FIGS. 5A and 5B illustrate a first connection form between gate driver ICs and gate lines.
Figure 6A:
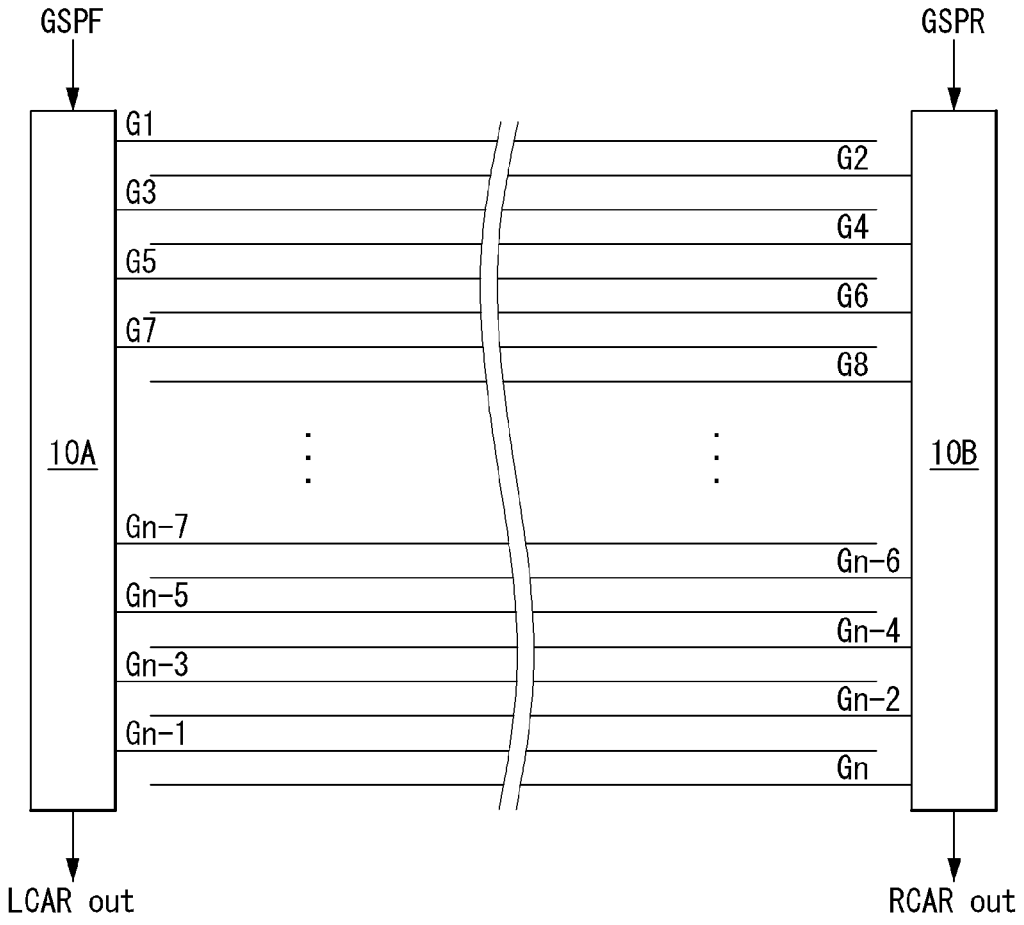
FIGS. 6A and 6B illustrate a second connection form between gate driver ICs and gate lines.

As shown in FIGS. 5A and 6A, when the first gate start pulse GSPF is supplied to the first gate driver IC LGIC1 of the first group disposed on the upper left side of the display panel and the second gate start pulse GSPR is supplied to the first gate driver IC RGIC1 of the second group disposed on the upper right side of the display panel, the gate driver ICs LGIC1 to LGIC6 of the first group and the gate driver ICs RGIC1 to RGIC6 of the second group operate in the first shift mode and shift the gate pulse along the first scan direction. Each of the gate driver ICs LGIC1 to LGIC6 of the first group outputs a carry signal LCAR transmitted to a start pulse input terminal of a next IC. For example, the first gate driver IC LGIC1 starts to output gate pulses SCAN1 to SCANn (refer to FIG. 3) in response to the first gate start pulse GSPF in the first shift mode and shifts downwards the gate pulses SCAN1 to SCANn. The first gate start pulse GSPF controls start timing of a first gate pulse output from a first output channel of the gate driver IC. In the gate driver ICs LGIC1 to LGIC6 of the first group, a Nth gate driver IC receives the carry signal LCAR output from a (N−1)th gate driver IC as a start pulse in the first shift mode, where N is a positive integer equal to or greater than 2. The Nth gate driver IC starts to output the gate pulses SCAN1 to SCANn and shifts downwards the gate pulses SCAN1 to SCANn.

The gate driver ICs RGIC1 to RGIC6 of the second group are connected to the gate lines in a shape where the gate driver ICs LGIC1 to LGIC6 of the first group rotate by 180°. Thus, when a shift direction of the gate driver ICs RGIC1 to RGIC6 of the second group is opposite to a shift direction of the gate driver ICs LGIC1 to LGIC6 of the first group, the gate pulse shift directions of the entire display panel are the same. Each of the gate driver ICs RGIC1 to RGIC6 of the second group outputs a carry signal RCAR transmitted to a start pulse input terminal of a next IC. For example, the first gate driver IC RGIC1 starts to output the gate pulses SCAN1 to SCANn in response to the second gate start pulse GSPR in the first shift mode and shifts downwards the gate pulses SCAN1 to SCANn. The second gate start pulse GSPR controls start timing of a first gate pulse output from a last output channel of the gate driver IC. In the gate driver ICs RGIC1 to RGIC6 of the second group, a Nth gate driver IC receives the carry signal RCAR output from a (N−1)th gate driver IC as a start pulse in the first shift mode. The Nth gate driver IC starts to output the gate pulses SCAN1 to SCANn and shifts downwards the gate pulses SCAN1 to SCANn. FIGS. 1, 3, 5A, and 6A illustrate the gate pulses SCAN1 to SCANn and the carry signals LCAR and RCAR of the gate driver ICs LGIC1 to LGIC6 and RGIC1 to RGIC6 in the first shift mode.

Figure 5B:
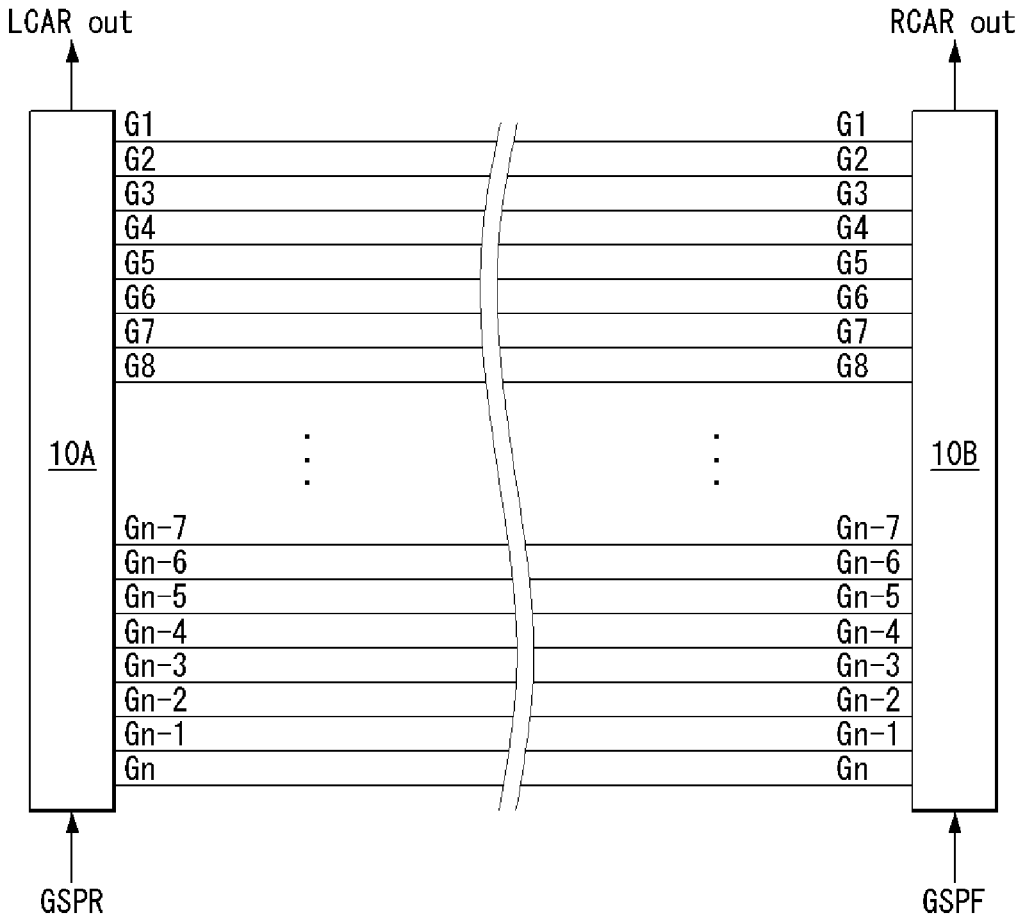
Figure 6B:
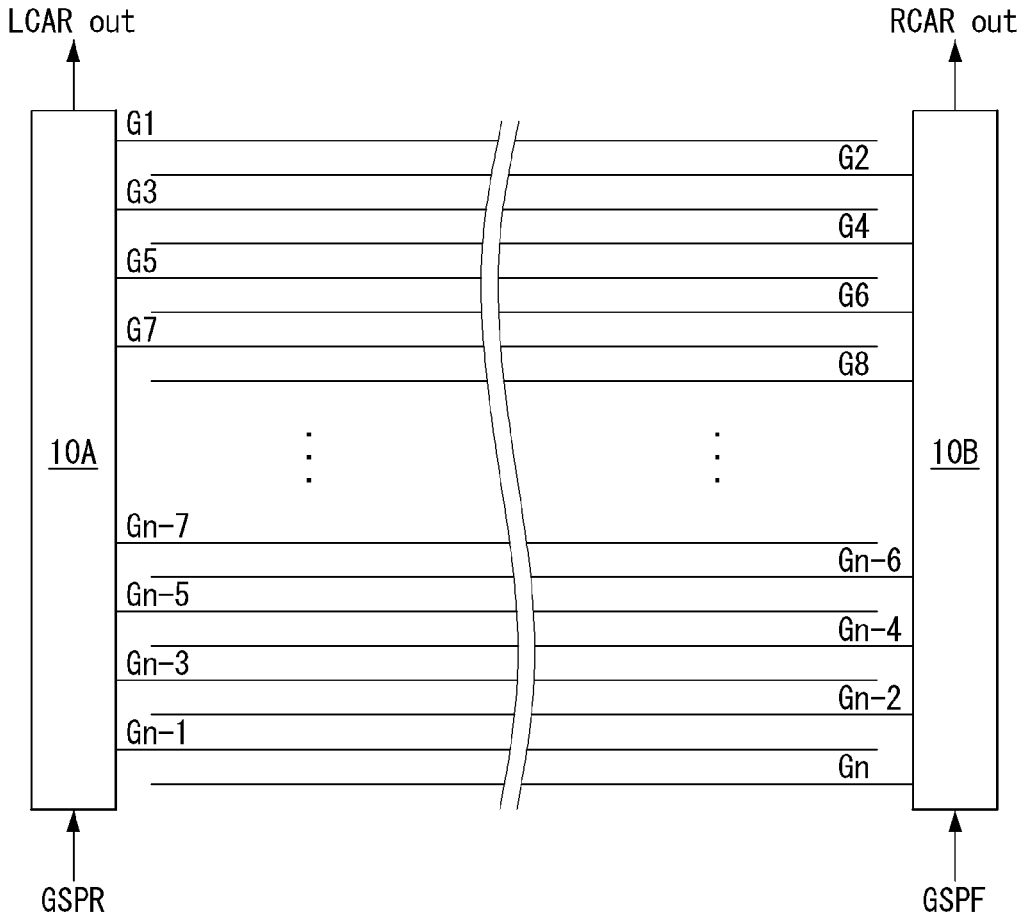

As shown in FIGS. 5B and 6B, when the second gate start pulse GSPR is supplied to the last gate driver IC LGIC6 of the first group disposed on the lower left side of the display panel and the first gate start pulse GSPF is supplied to the last gate driver IC RGIC6 of the second group disposed on the lower right side of the display panel, the gate driver ICs LGIC1 to LGIC6 of the first group and the gate driver ICs RGIC1 to RGIC6 of the second group operate in the second shift mode and shift gate pulses SCAN1 to SCANn (refer to FIG. 4) along the second scan direction. Each of the gate driver ICs LGIC1 to LGIC6 of the first group outputs the carry signal LCAR transmitted to a start pulse input terminal of a next IC. For example, the sixth gate driver IC LGIC6 starts to output the gate pulses SCAN1 to SCANn in response to the second gate start pulse GSPR in the second shift mode and shifts upwards the gate pulses SCAN1 to SCANn along the second scan direction. In the gate driver ICs LGIC1 to LGIC6 of the first group, a Nth gate driver IC receives the carry signal LCAR output from a (N+1)th gate driver IC as a start pulse in the second shift mode. The Nth gate driver IC starts to output the gate pulses SCAN1 to SCANn and shifts upwards the gate pulses SCAN1 to SCANn along the second scan direction.

Each of the gate driver ICs RGIC1 to RGIC6 of the second group outputs the carry signal RCAR transmitted to a start pulse input terminal of a next IC. For example, the sixth gate driver IC RGIC6 starts to output the gate pulses SCAN1 to SCANn in response to the first gate start pulse GSPF in the second shift mode and shifts upwards the gate pulses SCAN1 to SCANn along the second scan direction. In the gate driver ICs RGIC1 to RGIC6 of the second group, a Nth gate driver IC receives the carry signal RCAR output from a (N+1)th gate driver IC as a start pulse in the second shift mode. The Nth gate driver IC starts to output the gate pulses SCAN1 to SCANn and shifts upwards the gate pulses SCAN1 to SCANn along the second scan direction. FIGS. 2, 4, 5B, and 6B illustrate the gate pulses SCAN1 to SCANn and the carry signals LCAR and RCAR of the gate driver ICs LGIC1 to LGIC6 and RGIC1 to RGIC6 in the second shift mode.

FIGS. 5A and 5B illustrate a first connection form between the gate driver ICs and the gate lines. FIGS. 6A and 6B illustrate a second connection form between the gate driver ICs and the gate lines.

As shown in FIGS. 5A and 5B, gate driver ICs LGIC1 to LGIC6 of a first gate driving circuit 10A may be connected to all of gate lines G1 to Gn. In such a way, gate driver ICs RGIC1 to RGIC6 of a second gate driving circuit 10B may be connected to all of the gate lines G1 to Gn. The first and second gate driving circuits 10A and 10B simultaneously receive gate start pulses GSPF and GSPR and simultaneously output a gate pulse. Thus, the gate pulses output from the first and second gate driving circuits 10A and 10B are simultaneously applied to both ends of the same gate line, and carry signals LCAR and RCAR are simultaneously output from the gate driver ICs LGIC1 to LGIC6 and RGIC1 to RGIC6 of the first and second gate driving circuits 10A and 10B.

As shown in FIGS. 6A and 6B, the first gate driving circuit 10A is connected to gate lines of a first group and sequentially supplies the gate pulse to the gate lines of the first group. The second gate driving circuit 10B is connected to gate lines of a second group and sequentially supplies the gate pulse to the gate lines of the second group.

The gate lines of the first group may be odd-numbered gate lines G1, G3, . . . , and Gn−1, and the gate lines of the second group may be even-numbered gate lines G2, G4, . . . , and Gn. The gate start pulses GSPF and GSPR may be respectively applied to the first and second gate driving circuits 10A and 10B at a predetermined time interval. Thus, there may be a predetermined time interval between gate pulse output timings and between carry signal output timings of the first and second gate driving circuits 10A and 10B. For example, after about one horizontal period passed from the application of a first gate pulse from the first gate driving circuit 10A to the first gate line G1, a second gate pulse from the second gate driving circuit 10B may be applied to the second gate line G2. Further, after about one horizontal period passed from the output of the last carry signal LCAR from the sixth gate driver IC LGIC6 of the first gate driving circuit 10A, the last carry signal RCAR may be output from the sixth gate driver IC RGIC6 of the second gate driving circuit 10B. In FIGS. 6A and 6B, when the first and second gate driving circuits 10A and 10B normally operate, a time interval between the carry signals LCAR and RCAR output from the first and second gate driving circuits 10A and 10B is less than a reference value described below.

The gate lines of the first group and the gate lines of the second group are not limited to FIGS. 6A and 6B. For example, the gate lines of the first group may be gate lines formed on an upper half part or a left half part of the display panel, and the gate lines of the second group may be gate lines formed on a lower half part or a right half part of the display panel.

Figure 7:
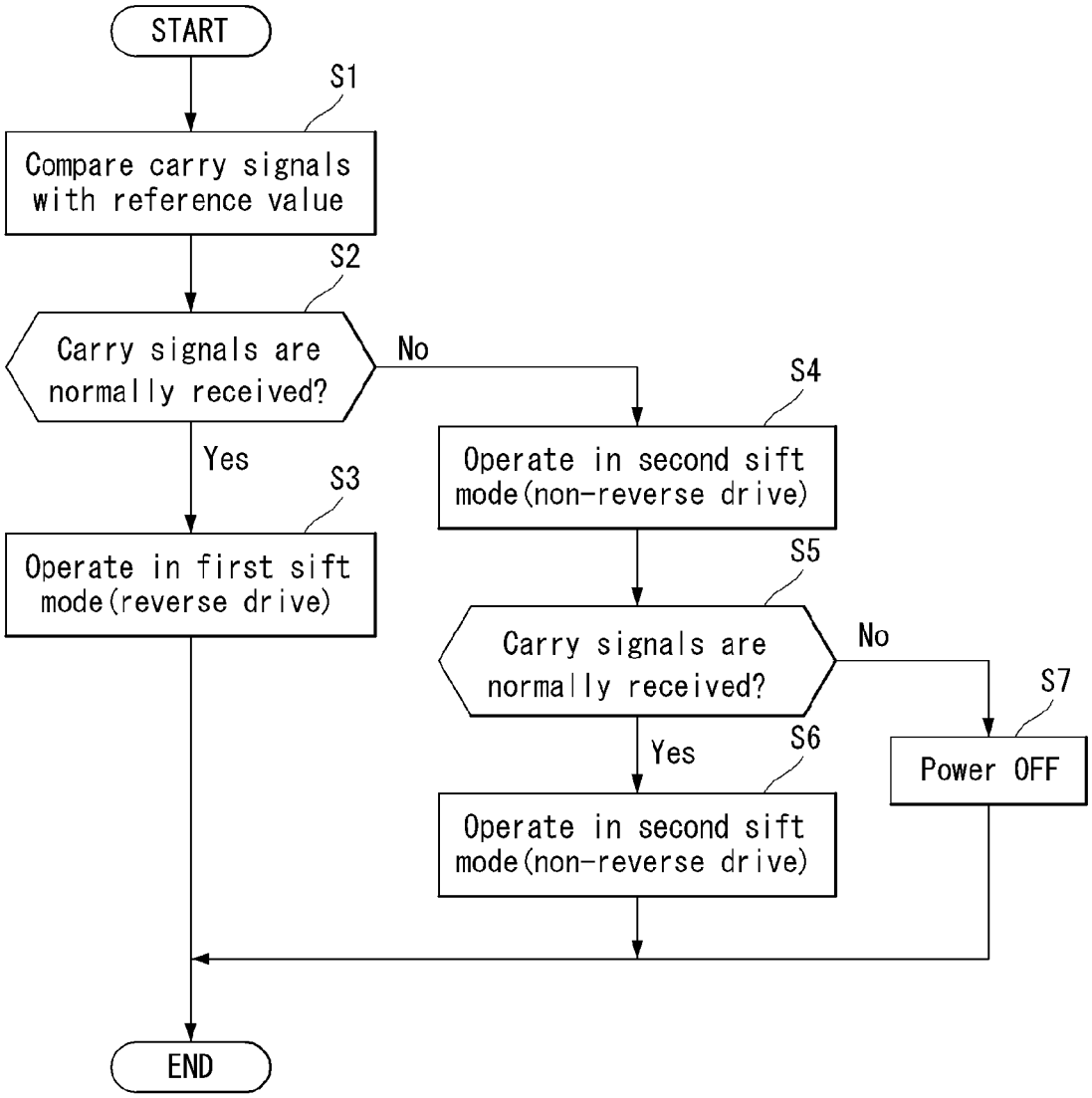
FIG. 7 is a flow chart illustrating a method of controlling a gate driving circuit according to an exemplary embodiment of the invention.
Figure 9:
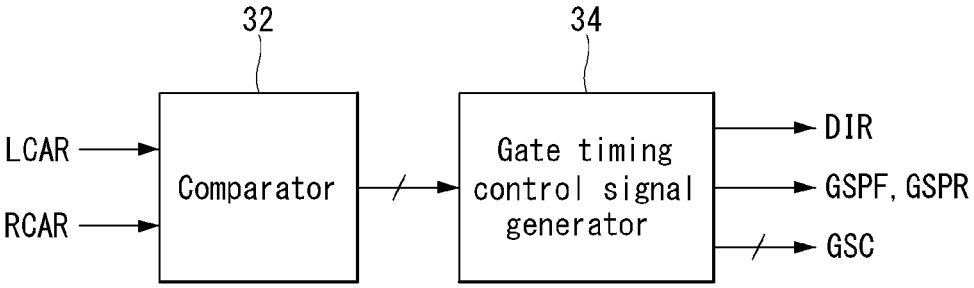
FIG. 9 is a block diagram illustrating a configuration of a timing controller related to a gate timing control.

FIG. 7 is a flow chart illustrating a method of controlling the gate driving circuit according to the embodiment of the invention. The timing controller TCON controls the gate driving circuits 10A and 10B using the gate timing control signal through the control method shown in FIG. 7. FIG. 8 illustrates input and output signals of the timing controller TCON. FIG. 9 is a block diagram illustrating a configuration of the timing controller TCON related to the gate timing control.

As shown in FIGS. 7 to 9, the timing controller TCON includes a comparator 32 and a gate timing control signal generator 34.

The timing controller TCON controls the gate driving circuits 10A and 10B in conformity with the first shift mode. The comparator 32 receives the carry signals LCAR and RCAR from the gate driving circuits 10A and 10B operating in the first shift mode, measures an input time interval between the carry signals LCAR and RCAR, and transmits the input time interval to the gate timing control signal generator 34 in step S1. A reference value may be set to a time interval between a gate timing signal GTC applied to the first gate driving circuit 10A and a gate timing signal GTC applied to the second gate driving circuit 10B. The gate timing control signal generator 34 compares the input time interval between the carry signals LCAR and RCAR with the reference value. When the input time interval is equal to or less than the reference value, the gate timing control signal generator 34 decides that the carry signals LCAR and RCAR are normally received and the first and second gate driving circuits 10A and 10B normally operate, thereby maintaining the first shift mode in steps S2 and S3.

On the contrary, when the input time interval between the carry signals LCAR and RCAR input through the comparator 32 is greater than the reference value, the gate timing control signal generator 34 decides that one of the gate driving circuits 10A and 10B does not operate, thereby controlling the gate driving circuits 10A and 10B in conformity with the second shift mode in step S4. When the shift direction of the gate driving circuits 10A and 10B changes, the gate driving circuits 10A and 10B may normally operate. For example, as shown in FIGS. 1, 5A, and 6A, in the first shift mode, the gate start pulses GSPF and GSPR are applied to the first gate driver ICs LGIC1 and RGIC1. However, if the LOG lines connected to start pulse input terminals of the first gate driver ICs LGIC1 and RGIC1 are short-circuited or opened, the gate start pulse may not be normally input to the first gate driver ICs LGIC1 and RGIC1. Therefore, the gate driving circuits 10A and 10B cannot operate in the first shift mode. When the gate driving circuits 10A and 10B are controlled in conformity with the second shift mode in such a bad state of the LOG lines, the gate start pulses GSPF and GSPR are normally input to start pulse input terminals of the sixth gate driver ICs LGIC6 and RGIC6 as shown in FIGS. 2, 5B, and 6B. Therefore, the gate driving circuits 10A and 10B can normally operate in the second shift mode.

When the input time interval between the carry signals LCAR and RCAR received from the gate driving circuits 10A and 10B operating in the second shift mode is equal to or less than the reference value, the gate timing control signal generator 34 maintains the second shift mode in step S6.

When the input time interval between the carry signals LCAR and RCAR received from the gate driving circuits 10A and 10B operating in the second shift mode is greater than the reference value, the gate timing control signal generator 34 turns off power of all of driving circuits in step S7. In FIG. 7, all of the driving circuits mean circuits required to drive the display panel including the timing controller, the gate driver ICs, the source driver ICs, a power supply circuit, etc.

The display device according to the embodiment of the invention may be implemented as the organic light emitting display. The organic light emitting display used as an example of the display device is described below with reference to FIGS. 10 and 11.

Figure 10:
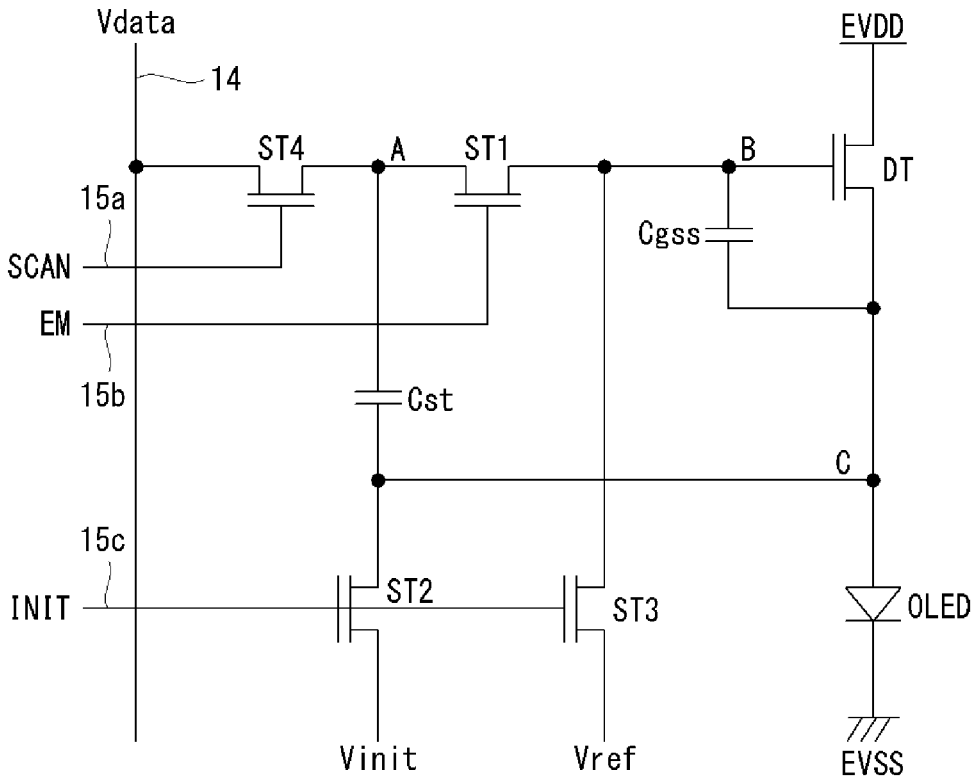
FIG. 10 is a circuit diagram illustrating an example of pixel configuration of an organic light emitting display.
Figure 11:
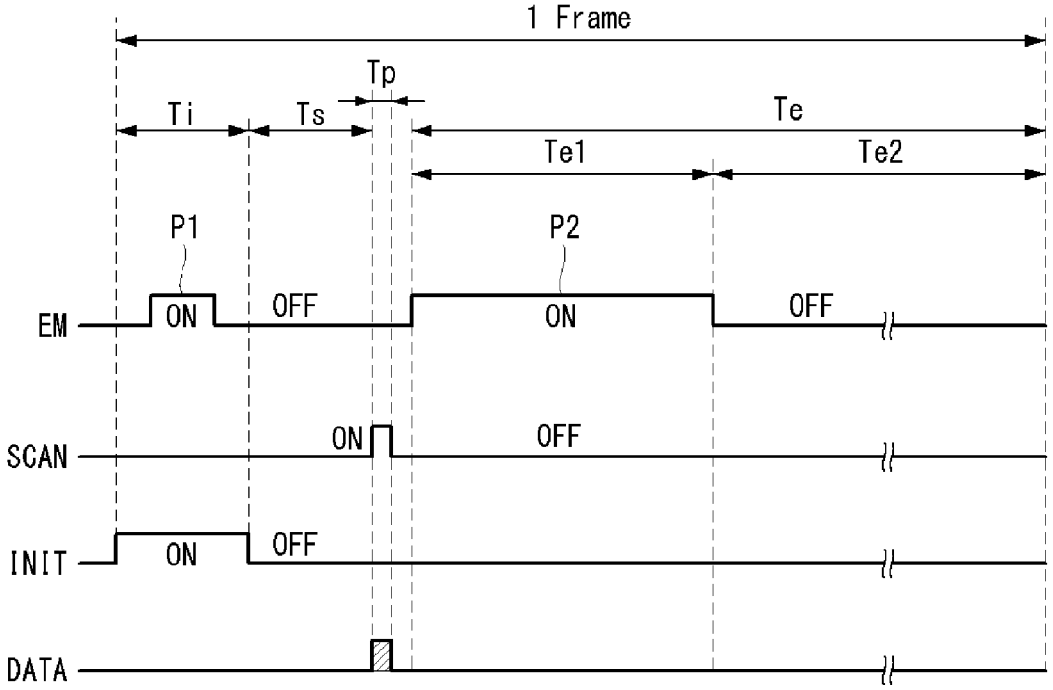
FIG. 11 is a waveform diagram showing a gate pulse supplied to a pixel shown in FIG. 10.

As shown in FIGS. 10 and 11, each of the gate lines G1 to Gn may include a scan line 15*a*, an emission line 15*b*, and an initialization line 15*c*. Each pixel P includes a plurality of thin film transistors (TFTs) DT and ST1 to ST4, capacitors Cst and Cgss, an organic light emitting diode (OLED), etc. The pixels P are not limited to configuration shown in FIG. 10 and may be implemented as any known OLED pixel circuit. For example, each pixel P includes an OLED, a driving element adjusting a current flowing in the OLED based on the data voltage, at least one switching element, at least one capacitor, etc. Each pixel P supplies the data voltage to a gate electrode of the driving element in response to a scan pulse and then causes the OLED to emit light in response to an emission control signal. Namely, the pixel P may be implemented as any known circuit that enables the OLED to emit light.

The gate driving circuits 10A and 10B sequentially supply a scan signal SCAN synchronized with the data voltage to the scan lines 15*a* under the control of the timing controller TCON and sequentially supply an emission control signal EM to the emission lines 15*b*. Further, the gate driving circuits 10A and 10B sequentially supply an initialization signal INIT to the initialization lines 15*c* in a sequential line manner. The scan signal SCAN, the emission control signal EM, and the initialization signal INIT each swing between a gate high voltage VGH and a gate low voltage VGL. The gate high voltage VGH is set to a voltage equal to or greater than a threshold voltage of a switching TFT included in the pixel P. On the other hand, the gate low voltage VGL is set to a voltage less than the threshold voltage of the switching TFT.

The OLED emits light by a current supplied from the driving TFT DT. Organic compound layers are stacked between an anode and a cathode of the OLED. The organic compound layers of the OLED include a hole injection layer HIL, a hole transport layer HTL, an emission layer EML, an electron transport layer ETL, an electron injection layer EIL, etc.

The driving TFT DT adjusts a current flowing in the OLED using a gate-source voltage of the driving TFT DT. A gate electrode of the driving TFT DT is connected to a node B, a drain electrode of the driving TFT DT is connected to an input terminal of a high potential cell driving voltage EVDD, and a source electrode of the driving TFT DT is connected to a node C.

The first switching TFT ST1 switches on or off a current path between a node A and the node B in response to the emission control signal EM. The first switching TFT ST1 transfers a data voltage Vdata stored in the node A to the node B through a turn-on of the first switching TFT ST1. A gate electrode, a drain electrode, and a source electrode of the first switching TFT ST1 are connected to the emission line 15*b*, the node A, and the node B, respectively.

The second switching TFT ST2 switches on or off a current path between an input terminal of an initialization voltage Vinit and the node C in response to the initialization signal INIT. The second switching TFT ST2 supplies the initialization signal INIT to the node C through a turn-on of the second switching TFT ST2. A gate electrode, a drain electrode, and a source electrode of the second switching TFT ST2 are connected to the initialization line 15*c*, the input terminal of the initialization voltage Vinit, and the node C, respectively.

The third switching TFT ST3 switches on or off a current path between an input terminal of a reference voltage Vref and the node B in response to the initialization signal INIT. The third switching TFT ST3 supplies the reference voltage Vref to the node B through a turn-on of the third switching TFT ST3. A gate electrode, a drain electrode, and a source electrode of the third switching TFT ST3 are connected to the initialization line 15*c*, the input terminal of the reference voltage Vref, and the node B, respectively.

The fourth switching TFT ST4 switches on or off a current path between a data line 14 and the node A in response to the scan signal SCAN. The fourth switching TFT ST4 supplies the data voltage Vdata to the node A through a turn-on of the fourth switching TFT ST4. A gate electrode, a drain electrode, and a source electrode of the fourth switching TFT ST4 are connected to the scan line 15*a,* the data line 14, and the node A, respectively.

The compensation capacitor Cgss is connected between the node B and the node C. The compensation capacitor Cgss enables to perform a source follower manner when a threshold voltage of the driving TFT DT is detected, and contributes to an improvement of a compensation capability for the threshold voltage.

The storage capacitor Cst is connected between the node B and the node C. The storage capacitor Cst stores the data voltage Vdata input to the node A and transfers the data voltage Vdata to the node C.

An operation of the pixel P is divided into an initialization period Ti for initializing the nodes A, B, and C to a specific voltage, a sensing period Ts for detecting and storing the threshold voltage of the driving TFT DT, a programming period Tp for applying the data voltage Vdata to the pixel P so as to write the data, and an emission period Te for supplying the current of the OLED through the driving TFT DT driven based on the data voltage Vdata, which is not affected by the threshold voltage of the driving TFT DT. The emission period Te may be divided into first and second emission periods Te1 and Te2.

In the initialization period Ti, the second and third switching TFTs ST2 and ST3 are simultaneously turned on in response to the initialization signal INIT of a high logic level. Further, the first switching TFT ST1 is turned on in response to a first pulse P1 of the emission control signal EM. The first pulse P1 of the emission control signal EM overlaps the initialization signal INIT. It is preferable, but not required, that a pulse of the initialization signal INIT is wider than the first pulse P1 of the emission control signal EM so as to stabilize the initialization. As a result, during the initialization period Ti, the initialization voltage Vinit is supplied to the node C, and the reference voltage Vref is supplied to the node B. Further, the reference voltage Vref is supplied to the node A via the first and third switching TFTs ST1 and ST3. The fourth switching TFT ST4 maintains an off-state during the initialization period Ti. The reference voltage Vref is set to be greater than the initialization voltage Vinit, so as to switch on a current path between the drain electrode and the source electrode of the driving TFT DT by setting a gate voltage of the driving TFT DT to be greater than a source voltage of the driving TFT DT.

The initialization voltage Vinit is properly set to a low value, so that the emission of the OLED is not prevented in the remaining periods Ti, Ts, and Tp except the emission period Te. For example, when the high potential cell driving voltage EVDD is set to 20V and the low potential cell driving voltage EVSS is set to 0V, the reference voltage Vref and the initialization voltage Vinit may be set to −1V and −5V, respectively.

The scan signal SCAN, the emission control signal EM, and the initialization signal INIT are shown in FIG. 11. The signals SCAN, EM, and INIT are shifted by the gate driving circuits 10A and 10B and are supplied to the gate lines G1 to Gn.

In the sensing period Ts, the emission control signal EM and the initialization signal INIT are inverted to a low logic level, and the scan signal SCAN is held at a low logic level. As a result, the first to fourth switching TFTs ST1 to ST4 maintain an off-state during the sensing period Ts, and a current Idt flowing through the driving TFT DT gradually decreases. When the gate-source voltage of the driving TFT DT reaches the threshold voltage of the driving TFT DT, the driving TFT DT is turned off. In this instance, the threshold voltage of the driving TFT DT is detected in the source follower manner and is charged to the node C.

In the programming period Tp, the fourth switching TFT ST4 is turned on by the scan signal SCAN of a high logic level synchronized with the data voltage Vdata of the input image. In this instance, the data voltage Vdata is supplied to the node A. The first to third switching TFTs ST1 to ST3 maintain an off-state during the programming period Tp. Because the nodes B and C are separated from the node A by the TFTs or the capacitors in the programming period Tp, the voltage in the sensing period Ts is almost held in the programming period Tp.

In the first emission period Te1, the first switching TFT ST1 is turned on in response to a second pulse P2 of the emission control signal EM. In this instance, the data voltage Vdata charged to the node A is transferred to the node B. The second to fourth switching TFTs ST2 to ST4 maintain an off-state during the first emission period Te1. The driving TFT DT supplies a current proportional to the data voltage Vdata transferred to the node B to the OLED during the first emission period Te1. During the first emission period Te1, the potential of the node C increases because of the current flowing through the driving TFT DT. When the potential of the node C increases to a voltage equal to or greater than a threshold voltage of the OLED, the potential of the node C increases to a voltage Voled capable of switching on the OLED. As a result, the OLED is turned on and emits light.

In the second emission period Te2, the first to fourth switching TFTs ST1 to ST4 maintain an off-state. The second emission period Te2 is set, so that it prevents the degradation of the first switching TFT ST1 to which the emission control signal EM is applied. For this, the emission control signal EM is inverted to a low logic level during the second emission period Te2, so as to compensate for a gate bias stress of the first switching TFT ST1.

When the pixels P are implemented as the circuit shown in FIG. 10, the threshold voltage of the driving TFT DT is detected through the source follower manner. In the source follower manner, the compensation capacitor is connected between the gate electrode and the source electrode of the driving TFT DT, and the source voltage of the driving TFT DT is followed to the gate voltage of the driving TFT DT when the threshold voltage of the driving TFT DT is detected. Furthermore, the drain electrode of the driving TFT DT is separated from the gate electrode of the driving TFT DT, and the high potential cell driving voltage EVDD is supplied to the drain electrode of the driving TFT DT. Therefore, the source follower manner may detect the negative threshold voltage of the driving TFT DT as well as the positive threshold voltage of the driving TFT DT. The pixels P float the gate electrode of the driving TFT DT when the threshold voltage of the driving TFT DT is sensed, and may improve a compensation performance of the threshold voltage using the compensation capacitors Cgss connected between the gate and source electrodes of the driving TFT DT and a parasitic capacitor of the driving TFT DT. If an on-duty of the emission control signal EM decreases, the degradation of the first switching TFT ST1 switched on or off in response to the emission control signal EM may be minimized.

As described above, the embodiment of the invention compares the carry signals output from the gate driving circuits when the gate driving circuits are disposed on both sides of the display panel, and changes the shift mode based on a result of comparison. As a result, the display device according to the embodiment of the invention may prevent only a portion of the screen of the display panel from being driven by the incorrect operation or the operation failure of some of the gate driving circuits and may prevent the excitation of the polarizing film resulting from the heat generation of the gate driving circuits.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device comprising:

a display panel including data lines, gate lines crossing the data lines, and a pixel array;

first and second gate driving circuits which are respectively disposed on both sides of the display panel with the pixel array interposed between them; and a timing controller configured to control a shift direction of the first and second gate driving circuits using a gate timing control signal, wherein the first and second gate driving circuits shift a gate pulse supplied to the gate lines along a first scan direction in a first shift mode and shift the gate pulse along a second scan direction opposite to the first scan direction in a second shift mode, and wherein the timing controller controls the first and second gate driving circuits in conformity with the first shift mode, compares carry signals received from the first and second gate driving circuits, and controls the first and second gate driving circuits in conformity with the second shift mode when a time interval between the carry signals is greater than a previously determined reference value.

2. The display device of claim 1, wherein the timing controller compares the carry signals received from the first and second gate driving circuits operating in the second shift mode, wherein when a time interval between the carry signals is greater than the reference value, power of the first and second gate driving circuits and the timing controller are turned off.

3. The display device of claim 1, wherein the first and second gate driving circuits simultaneously supply the gate pulse to both sides of the same gate line and simultaneously output the carry signals.

4. The display device of claim 1, wherein the first gate driving circuit is connected to gate lines of a first group and sequentially supplies the gate pulse to the gate lines of the first group, wherein the second gate driving circuit is connected to gate lines of a second group and sequentially supplies the gate pulse to the gate lines of the second group, wherein there is a time interval between the carry signal output from the first gate driving circuit and the carry signal output from the second gate driving circuit, and wherein the time interval between the carry signals is less than the reference value when the first and second gate driving circuits normally operate.

5. A method of controlling a gate driving circuit of a display device including a display panel including data lines, gate lines crossing the data lines, and a pixel array, first and second gate driving circuits which are respectively disposed on both sides of the display panel with the pixel array interposed between them, and a timing controller controlling a shift direction of the first and second gate driving circuits using a gate timing control signal, the method comprising:

controlling the first and second gate driving circuits in conformity with a first shift mode;

comparing carry signals received from the first and second gate driving circuits; and when a time interval between the carry signals is greater than a previously determined reference value, controlling the first and second gate driving circuits in conformity with a second shift mode, wherein the first and second gate driving circuits shift a gate pulse supplied to the gate lines along a first scan direction in the first shift mode and shift the gate pulse along a second scan direction opposite to the first scan direction in a second shift mode.

6. The method of claim 5, further comprising:

comparing the carry signals received from the first and second gate driving circuits operating in the second shift mode; and when a time interval between the carry signals is greater than the reference value, turning off power of the first and second gate driving circuits and the timing controller.

* * * * *